United States Patent [19]

Thienemann

[11] B 3,983,804

[45] Oct. 5, 1976

[54] PRINTING DEVICE OPERATING WITH A CYCLOIDAL PRINTING MOTION FOR DATA PROCESSING MACHINES

[75] Inventor: Joachim Thienemann, Hamburg, Germany

[73] Assignee: U.S. Philips Corporation, New York, N.Y.

[22] Filed: Aug. 13, 1974

[21] Appl. No.: 496,999

[44] Published under the second Trial Voluntary Protest Program on January 27, 1976 as document No. B 496,999.

[30] Foreign Application Priority Data

Aug. 16, 1973 Germany ..... 2341347

[52] U.S. Cl. ..... 101/93.13; 101/111; 197/18

[51] Int. Cl.² ..... B41J 1/20; B41J 7/36

[58] Field of Search ..... 101/111, 105, 93.13; 197/18

[56] References Cited

UNITED STATES PATENTS

| | | | |
|---|---|---|---|
| 823,080 | 6/1906 | Richards | 197/18 |
| 3,144,820 | 8/1964 | Wales, Jr. | 197/18 X |

OTHER PUBLICATIONS

Western Electric Technical Digest, No. 28, 10–1972, Endless Carrier Printers, p. 23.

*Primary Examiner*—Paul E. Shapiro
*Attorney, Agent, or Firm*—Frank R. Trifari

[57] ABSTRACT

A printing device operating with a cycloidal printing motion and having a revolving type carrier. The types on the type carrier are guided over a cycloidal path by a planetary gear drive. The type is carried on an elastic band which is carried between two rollers.

3 Claims, 2 Drawing Figures

PRINTING DEVICE OPERATING WITH A CYCLOIDAL PRINTING MOTION FOR DATA PROCESSING MACHINES

The invention relates to a printing device operating with a cycloidal printing motion and comprising a revolving type carrier, the types of which are guided over cycloidal paths by a planetary gear drive having two degrees of freedom, a selected character being printed at a predetermined stationary point of the cycloidal path, the shafts of the sun gear and the planet gear being interconnected by a connection member so as to be laterally shifted with respect to each other.

In known printing devices of this kind the types to be printed are guided such that they are rolled down onto the record carrier during printing. The rolling motion is effected by a drive, usually a planetary gear drive, the circulating planet gear of which takes along the type carrier. For the type carrier use is made of a circular disc or a cylinder, the types being provided on the circumference thereof. Because the type carrier and the planet gear are coupled to the sun gear by way of a connection member, the type carrier can be adjusted for the character to be printed by rotation and positioning of the sun gear. The record carrier is tangentially arranged with respect to the stationary point circle of the movement of the type carrier, with the result that the type carrier is guided along the printing location during the rotation of the connection member so that printing takes place.

Because on the one hand the printing speed is dependent of the inertia of the parts of the printing device to be moved during the adjustment thereof, the type carrier cannot be arbitrarily large, so that on the other hand the number of characters provided on the carrier is limited. Moreover, in the case of a large diameter of the type carrier, adjoining characters are also liable to be printed. This risk can be precluded by using instead of a type disc a type cylinder on which the types are arranged in various rings. However, the mass of the type carrier is then increased. In addition, the selection of the characters is then effected by a special switchover device. Consequently, in a printing device of this kind an additional lifting motion must be performed. It was found that the number of characters of the known printing devices operating with a cycloidal printing motion can be extended only by a large number of mechanical means, which causes a low printing speed because of the increased mass inertia.

The invention has for its object to provide the type carrier of a printing device operating with a cycloidal printing motion with a large number of characters, without loosing the advantage of small moments of inertia. According to the invention this is achieved in that the connection member is provided on both ends with a roller, one roller serving as a pressure roller whilst the other roller serves as a guide roller for an elastic band arranged about the two rollers, the pressure roller being driven by the planet gear. The guide roller can either be mounted on the shaft of the sun gear or the connection member can be extended such that the axis of the guide roller does not coincide with the axis of the sun gear. The number of characters can be further increased by guiding the bandshaped type carrier as a Mobius band about the two rollers and by providing it with characters on both sides. In this case the type carrier can be of a very small construction in the form of an endless elastic band. A type carrier of this kind has a comparatively small mass and hence a small moment of inertia. Moreover, such a type of carrier also permits of small dimensions of the planet drive gear, which again results in a decrease of the moments of inertia of the drive itself.

The invention will be described in detail hereinafter with reference to one embodiment.

Figure 1:
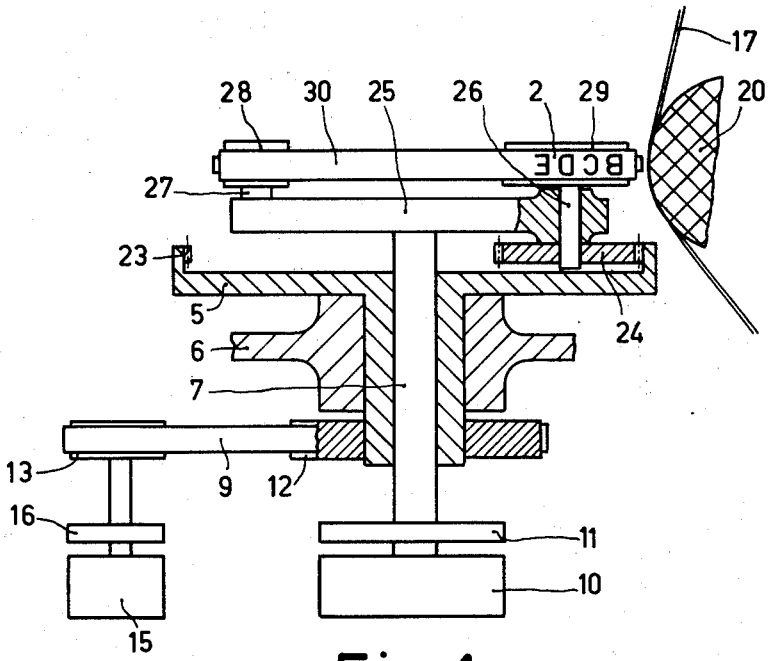
FIG. 1 is a sectional view of a printing device according to the invention.
Figure 2:
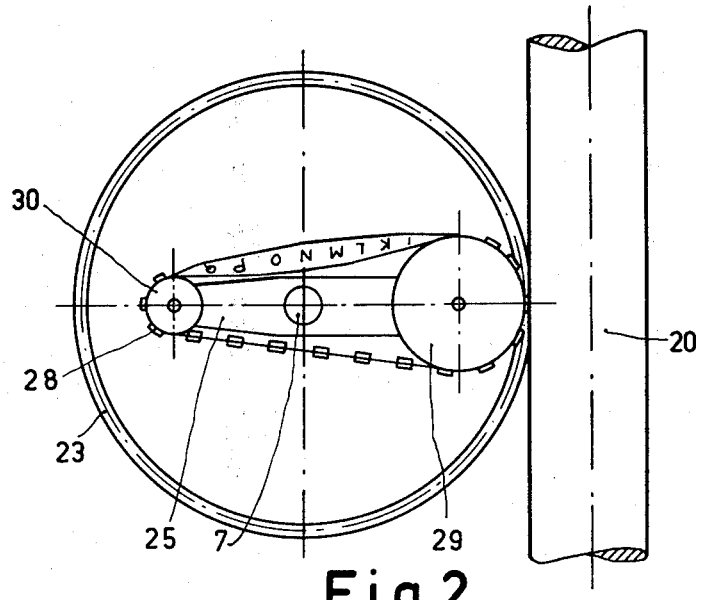
FIG. 2 is a plan view of the printing device shown in FIG. 1.

All parts of the printing device shown which are not absolutely necessary for the proper understanding of the invention have been omitted in the drawing and are assumed to be known. The shaft 7 for the sun gear 5 is journalled to be rotatable in a frame 6 which is not shown in detail. The sun gear 5 has a hollow shaft or sleeve fixed thereto which is journalled on the shaft 7 and which is itself rotatable in the frame 6. The upper part of the sun gear 5 has an upstanding peripheral flange provided with internal teeth on the edges. Mounted on the other end of the sleeve of the sun gear 5 is a pulley 12 which is connected to the wheel 13 by way of the belt 9. This wheel is driven by the drive motor 15. The shaft 7 of the sun gear 5 is directly coupled to the drive motor 10. The references 11 and 16 denote angle detectors which are capable of electrically detecting the individual positions of the sun gear and the connection member 25.

The connection member 25 is mounted on the shaft 7. The rollers 28 and 29 are arranged to be rotatable on the ends of this connection member 25. The roller 28 serves as a guide roller for the type band 30 and is journalled on the shaft 27. The roller 29 is rigidly connected to the shaft 26 and serves as the pressure roller for the type band 30. The shaft 26 is journalled to be rotable in the connection member 25 and supports, in addition to the pressure roller 26, the planet gear 24 which rolls down on the internal teeth 23 of the sun gear 5.

The type band 30 consists of an endless elastic band and the various characters to be printed are provided on its outer side. In order to be printed, the selected character is rolled onto the record carrier 17 through an intermediate ribbon (not shown). The record carrier is guided about a thrust bearing 20. If the number of characters is comparatively small, the guide roller 28 can alternatively be journalled to be rotatable directly on the extended shaft 7 projecting through the connection member 25. However, if the number of characters to be printed is comparatively large, the elastic type band 30 can be provided with types on both sides. In that case the type band 30 is guided about the two rollers 28 and 29 as a Mobius band. To this end, the rollers 28 and 29 are provided with a groove to accommodate the characters remote from the printing location. The band 30 is then guided over the rollers 28 and 29 only by its edge.

What is claimed is:

1. A printing device operating with a cycloidal printing motion and having a revolving type carrier, the types of which are guided over cycloidal paths by a planetary gear drive having two degrees of freedom, a selected character being printed at the stationary points of the cycloidal path, comprising a sun gear mounted for rotation about a first axis, a connection member fixed to said first axis, a second axis rotatably carried at one end of said connection member, a planet gear mounted for rotation about said second axis in engagement with said sun gear, a pressure roller coupled to said planet gear and mounted for rotation about said second axis, a third axis carried by said connection member spaced from said first end, a guide roller mounted to said connection member for rotation about said third axis, and an elastic band carrying type arranged about said pressure and guide rollers.

2. A printing device as claimed in Claim 1, wherein an imaginary plane extends through said first, second and third axes.

3. A printing device as claimed in claim 2, said elastic band is a Mobius band and is provided with types on both sides thereof.

* * * * *